United States Patent [19]

Urushizaki

[11] 4,238,271

[45] Dec. 9, 1980

[54] ADHESIVE TAPE APPLICATOR

[76] Inventor: Sakae Urushizaki, No. 4-1, Nishidotonbori-dori 5-chome, Nishi-ku, Osaka-shi, Osaka-fu, Japan

[21] Appl. No.: 17,256

[22] Filed: Mar. 5, 1979

[51] Int. Cl.[2] ..... B32B 31/00; B44C 7/00; B44C 7/06; B65B 67/06

[52] U.S. Cl. ..... 156/523; 156/577

[58] Field of Search ..... 156/523, 577

[56] References Cited

U.S. PATENT DOCUMENTS

| | | | |
|---|---|---|---|
| 3,523,053 | 8/1970 | Zbinden | 156/523 |
| 3,850,779 | 11/1974 | Pearson | 156/523 |
| 4,097,328 | 6/1978 | Urushizaki | 156/577 |

*Primary Examiner*—Douglas J. Drummond

*Attorney, Agent, or Firm*—Armstrong, Nikaido, Marmelstein & Kubovcik

[57] ABSTRACT

A tape applicator for rotatably mounting a roll of adhesive tape to adhere the tape to an article and cut off the desired length of adhered tape comprising a roller belt for mounting the tape roll on an annular portion with the belt interposed therebetween, a finger inserting apertured portion defined by the annular portion and providing a finger engaging portion, and a safety stopper and a cutter attached to the applicator main body. The cutter is slanted toward one end of the applicator from the front side to the rear side thereof. The applicator is safe to use without causing any injuries to the finger, and well-balanced and easy to use even if large-sized. The tape is applicable under suitable tension and therefore will not be creased or warp the article.

4 Claims, 7 Drawing Figures

ADHESIVE TAPE APPLICATOR

BACKGROUND OF THE INVENTION

The present invention relates to a novel adhesive tape applicator, and more particularly to a novel device for applying an adhesive tape such as a cellophane tape to surface or articles which is adapted to accommodate a roll of adhesive tape therein as mounted on a tubular mount with a roller belt interposed between the roll and the mount and by which a length of tape can be applied to the article to be adhered and cut off when the device as placed on the article is depressed and at the same time pulled in the desired direction by fingers inserted in a center aperture of the device and the apertured portion is thereafter pulled as if pressing a trigger.

Adhesive tape applicators have been proposed in recent years by which the desired length of adhesive tape can be applied to a surface or an article, for example, for sealing an envelop, joining two pieces of paper or reinforcing a corner portion of a piece of paper. In such a case, difficulty is experienced in neatly cutting off the desired length of adhesive tape, or there is a need to touch the tacky side of the tape with a finger, or it is difficult to apply the desired length of adhesive tape under suitable tension. Consequently the applied tape is liable to have creases, to warp the article adhered or to become partly peeled off.

The present inventor conducted years of research and developed an adhesive tape applicator free of the foregoing problems as disclosed in the specification of U.S. Pat. No. 4,097,328.

OBJECTS OF THE INVENTION

An object of the present invention is to provide a novel adhesive tape applicator in which an adhesive tape is applicable under suitable tension and therefore will not be creased or warp an article.

Another object of the invention is to provide a novel adhesive tape applicator which is ease to use, even if large-sized.

Further object of the invention is to provide a novel adhesive tape applicator which can cut off readily the adhered portion of a tape with fingers alone without use of a great resilience of a spring.

Still further object of the invention is to provide a novel adhesive applicator which is safe to use without causing any injures to fingers.

Other objects of the invention will become apparent from the following description given with reference to the accompanying drawings.

DETAILED DESCRIPTION

Figure 2:
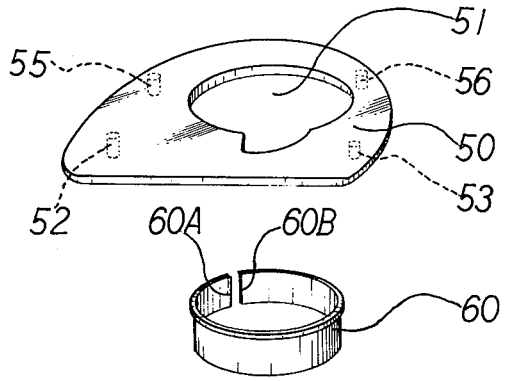
FIG. 2 is an exploded view showing the embodiment of FIG. 1.
Figure 1:
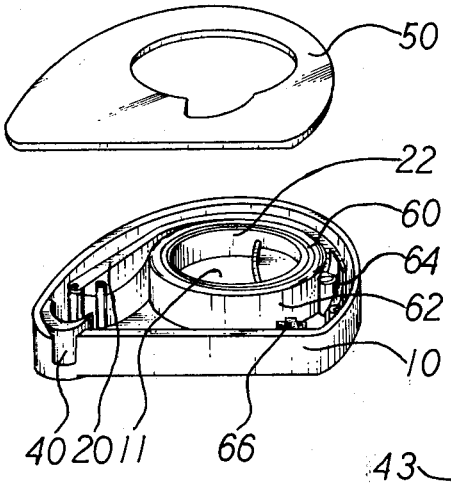
FIG. 1 is a perspective view showing an embodiment of adhesive tape applicator of the present invention.
Figure 1:
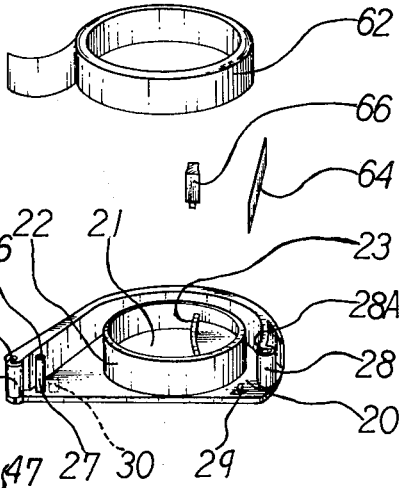
Figure 1:
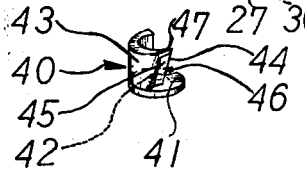
Figure 1:
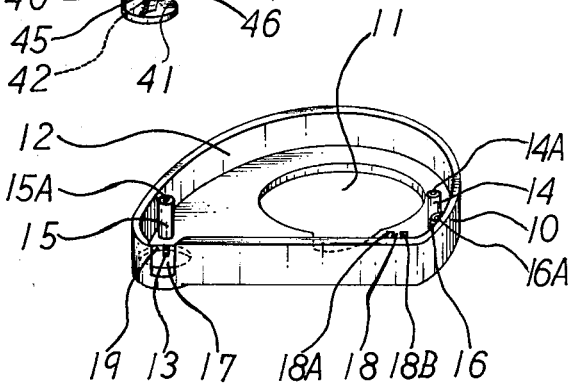

Referring first to the embodiment of adhesive tape applicator of the invention shown in FIGS. 1 and 2, numerals 10, 20, 40, 50, 60, 62, 64 and 66 designate an applicator main body, a swing member, a rotatable member, a cover, a roller belt, an adhesive tape roll, a spring and a safety stopper, respectively. The main body 10, swing member 20, rotatable member 40, cover 50 and stopper 66 are made of synthetic resin. Preferably the cover 50 and main body 10 are transparent. The swing member 20 is disposed centrally of the body 10 and pivotably supported at the right end of the body, while the rotatable member 40 is supported at a left end lower portion of the body 10. The swing member 20 is formed at its center with an annular portion 22 for rotatably mounting the adhesive tape roll 62 with a roller belt 60 interposed between the portion 22 and the roll 62. The cover 50 is detachably fittable to the body 10.

As seen in FIG. 2, the body 10 has an interior space 12 defined by a rear wall and a peripheral wall and opened to its front side. The rear wall has a finger inserting aperture 11 and is provided with a first pin 13 at a lower portion of its left end, a second pin 14 positioned at the midportion of its right end and having a center bore 14A, a third pin 15 in contact with the peripheral wall at the left end and having a center bore 15A, and a fourth pin 16 in contact with the peripheral wall at the right end and having a center bore 16A. These pins 13 to 16 extend upright from the rear wall toward the front side of the body 10. The body 10 further has an opening 17 formed in the bottom wall at the left end, two ribs 18A and 18B extending from the rear wall toward the front side and integral with the bottom wall to define a guide groove 18, and a cavity 19 formed in the rear wall and centered about the first pin 13 for guiding a disc 41 of the rotatable member 40.

The swing member 20 has a finger inserting aperture 21 defined by the center annular portion 22 which extends from the rear wall of the member 20 toward its front side. At the right side of the aperture 21, the annular portion 22 has a finger engaging piece 23. The swing member 20 further has a first shaft 24 at a left end bottom portion, a press roller 25 mounted on the shaft 24, a second shaft 26 arranged adjacent to and on the right side of the shaft 24, a guide roller 27 mounted on the second shaft 26, a tubular portion 28 positioned at the middle of its right end, extending from the rear wall toward the front side and having a center bore 28A, a hole 29 formed in the rear wall and positioned at the right end close to the bottom, and a pin 30 adjacent to the second shaft 26 and extending from the rear wall rearward (indicated in a broken line).

The press roller 25, which is made as of polyvinyl chloride resin, need not be rotatable on the first shaft 24 but may be secured thereto. When the swing member 20 turned counterclockwise in FIG. 3 with its tubular portion 28 supported by the second pin 14, the press roller 25 projects downward from the bottom opening 17 of the body 10, acting to press the leading end 62*a* of the tape.

The guide roller 27 is prepared by applying polyvinyl chloride resin or like material to a knitted fiber tube to form a thin coating thereon and is rotatably mounted on the second shaft 26. The guide roller 27 is rotatable on the shaft 26 with a suitable frictional force acting therebetween while exhibiting a slight tendency to adhere to the tacky side of the tape 62. Consequently the tape 62 is partly held in intimate contact with the guide roller 27 at all times.

The rotatable member 40 includes the aforementioned disc 41 on its rear side. The disc 41 has a center hole 42 and a circular arc peripheral wall 43 projecting from the disc 41 toward the front side and having an end 44 slanting leftward from the front side toward the rear side. The slanting end 44 is provided with a protecting projection 47 at its front side. A cutter 45 is attached to the slanting end 44. The disc 41 is further formed with an elongated cutout groove 41 radially extending from a peripheral portion thereof. The first pin 13 on the rear wall of the body 10 is fitted in the hole 42 of the disc 41 which is received in the cavity 19, the pin 13 thus rotatably supporting the member 40. The pin 30 on the rear side of the rear wall of swing member 20 is engaged in the elongated groove 41, so that the swing member 20, when turned in a direction, rotates the rotatable member 40 in the opposite direction. When the cutter 45 is detachably mounted on the rotatable member 40, the cutter 45 is replaceable if worn away.

The roller belt 60 is in the form of a cut ring having cut ends 61 and 62 and an inverted L-shaped section. The belt is made of synthetic resin or metal and serves to impart suitable friction to the tape roll 62 when the roll 62 is rotatably mounted on the annular portion 22 of the swing member 20 with the split ring 60 provided therebetween.

The cover 50 has a finger inserting aperture 51 in its center and is formed on the rear side thereof with a first projection 52 at a left end lower portion, a second projection 53 at a right end lower portion, a first rib 55 at a left end upper portion, and a second rib 56 at a right end upper portion. The ribs 55 and 56 function as a stopper to prevent the swing member 20 from striking against the pheripheral wall of the main body 10. The first projection 52 is engageable in the center bore 15A of the third pin 15 on the body 10, and the second projection 53 is engageable in the center bore 14A of the second pin 14. Thus the cover 50 is detachably fittable to the body 10 by the first and second projections 52 and 53.

The adhesive tape applicator of the invention will be used in the following manner with the advantages described below.

In FIGS. 3 to 7, the adhesive tape applicator of the invention is shown in the state that the cover 50 is removed.

Figure 3:
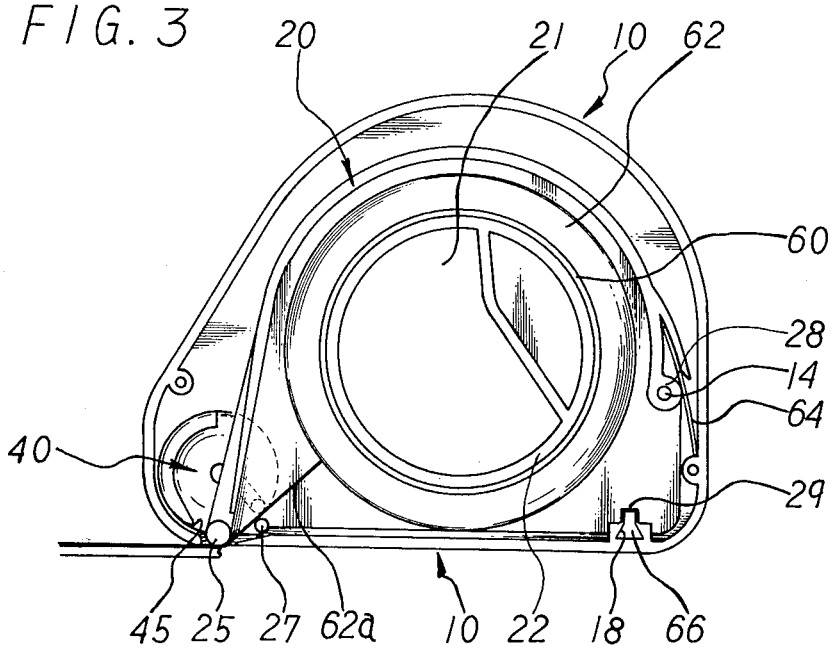
FIG. 3 is a side elevation showing the embodiment of FIG. 1 with a roll of adhesive tape placed therein.
Figure 4:
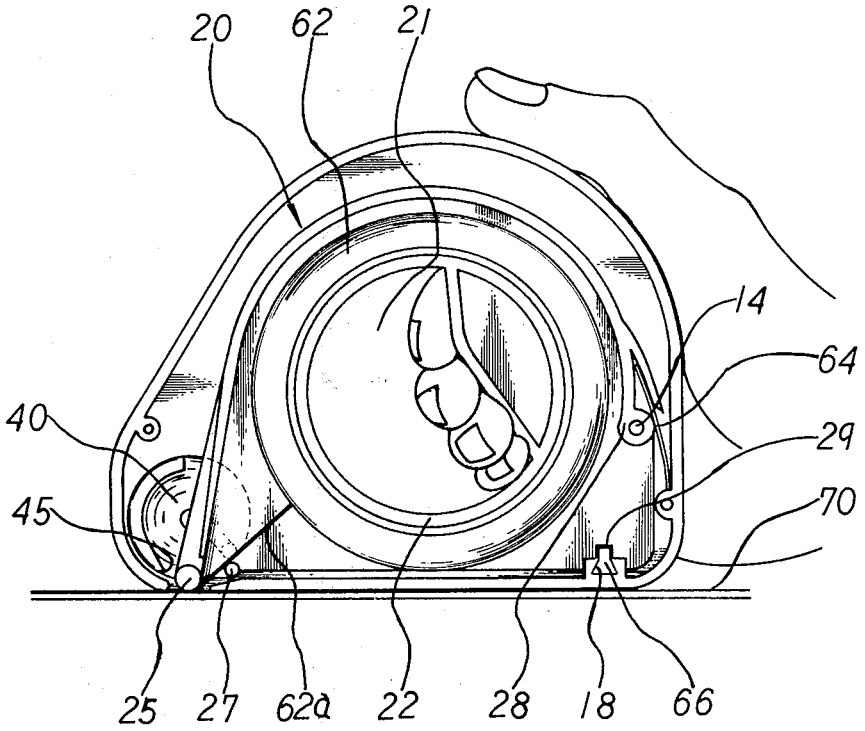
FIG. 4 is a side elevation showing the embodiment of FIG. 1 while the adhesive tape is being applied to an article.
Figure 5:
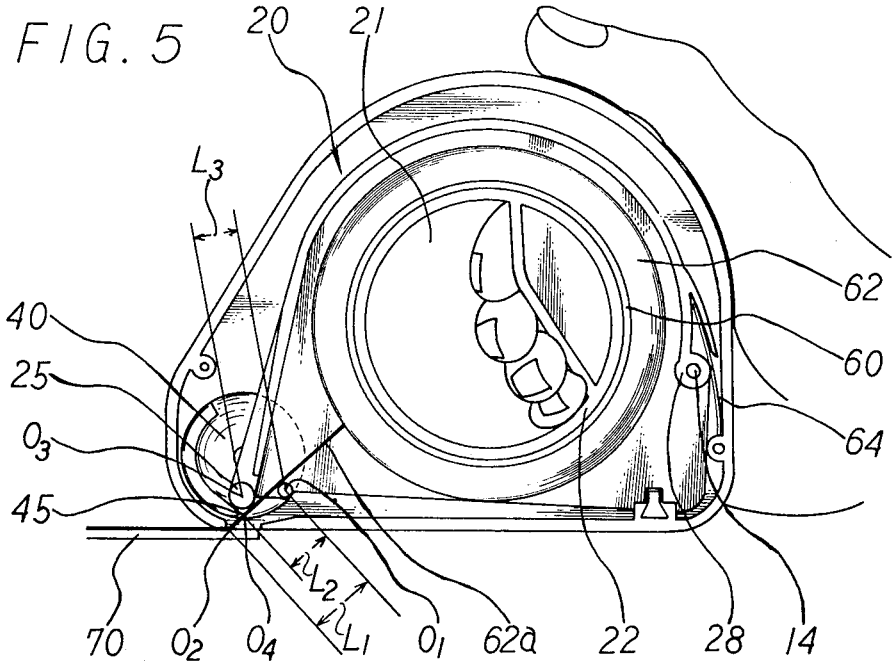
FIG. 5 is a side elevation showing the embodiment of FIG. 1 when the tape is to be cut.

With reference to FIGS. 3 to 5, the tape roll 62 is rotatably mounted on the annular portion 22 of the swing member 20 with the revolving ring 60 provided therebetween. As seen in FIG. 2, the opposed cut ends 61 and 62 of the belt 60 are spaced apart by a relatively large distance, giving the belt a relatively large outside diameter. The tape roll 62 is mounted on the annular portion 22 with the belt 60 fitted in the roll 62 while radially pressing the belt to reduce the above-mentioned distance as seen in FIGS. 3 to 5. Accordingly the ring 60 which is fitted in place in the pressed state, resiliently acts to restore itself to the state of FIG. 2. Thus the belt resiliently acts to impart a suitable frictional force to the inner periphery of the tape roll 62 at all times during the rotation of the tape roll 62.

With reference to FIG. 3, fingers are placed into the aperture 21 of the swing member 20 through the aperture 11 of the main body 11 with the cover 50 removed, and the swing member 20 is pushed down with the fingers, whereby the swing member 20 is turned counterclockwise in FIG. 3 about the second pin 14 supporting the tubular portion 28. In this state (namely the state shown in FIG. 3), the safety stopper 66 in the guide groove 18, when pushed further rearward, engages in the hole 29 formed in the swing member 20 and locks the swing member 20 to the main body 10. This completely prevents the rotatable member 40 from rotation, eliminating the hazard that the cutter 45 on the rotatable member 40 will injure the finger.

Subsequently the leading end **62*a* of the tape 62 is pulled with fingers out to the bottom opening 17 below the press roller 25, causing the tacky side of the tape to contact the guide roller 27. While holding the swing member 20 in its depressed position with the fingers placed in the apertures 11 and 21, the safety stopper 66 is manually shifted upward, freeing the swing member 20 from its locked position. The swing member 20 is now turnable. When the cover 50 is fitted to the main body 10**, the applicator is ready for use.

The applicator in this state (shown in FIG. 3) is placed on the desired article 70 to which the tape is to be applied. The hand is then moved rightward to pull the applicator while depressing the same, whereby the tape 62 is paid out over the guide roller 27 and the press roller 25 (shown in FIG. 4) for application. At this time, the guide roller 27 rotates on the second shaft 26 (shown in FIG. 2) suitable constant friction maintained between the inner periphery of the roller 27 and the outer periphery of the shaft 26 at all times while the outer periphery of the guide roller 27 exhibits a slight tendency to adhere to the tacky side of the tape 62. Consequently the tape 62 is partly held in slightly frictional, intimate contact with the guide roller 27 at all times and retains specified tension, which in turn enables the leading tape end to remain in slight contact with the press roller 25 after the tape 62 is subsequently cut in the manner to be described below.

Figure 6:
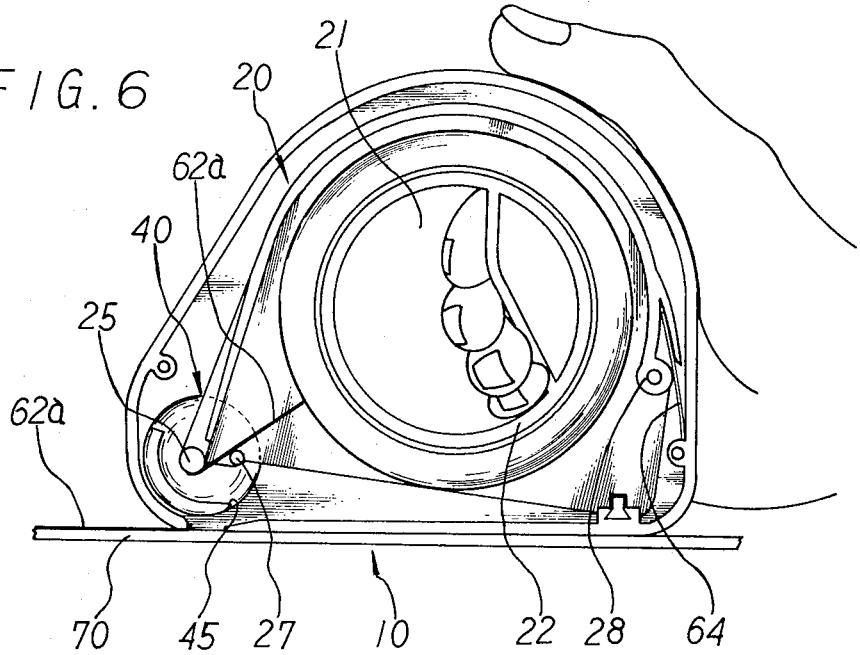
FIG. 6 is a side elevation showing the embodiment of FIG. 1 after the adhesive tape has been cut.

Next, of the fingers inserted in the apertures 11 and 21, the forefinger alone is forcibly pulled as if pressing a trigger to retract the press roller 25 into the body 10 while causing the cutter 45 on the rotatable member 40 to cut the tape 62 below the press roller 25. When the forefinger alone is further strongly pulled, the extremity of the fresh leading end **62*a* of the tape 62 comes into contact with the bottom of the press roller 25 as seen in FIG. 6. When the forefinger alone is still further pulled, the swing member 20 is brought to the position shown inFIG. 7 and stops. To apply the tape 62 to another article to be adhered, fingers are placed in the apertures 11 and 21, and the applicator is placed on the article and pulled rightward in the manner already described with reference to FIGS. 4 to 7. This procedure can be followed with the fingers alone even in the absence of the spring 64. The spring 64 nevertheless facilitates this procedure and serves to automatically return the swing member 20 so that the tape leading end 62*a*** will not project from the bottom opening while the applicator is not in use.

Figure 7:
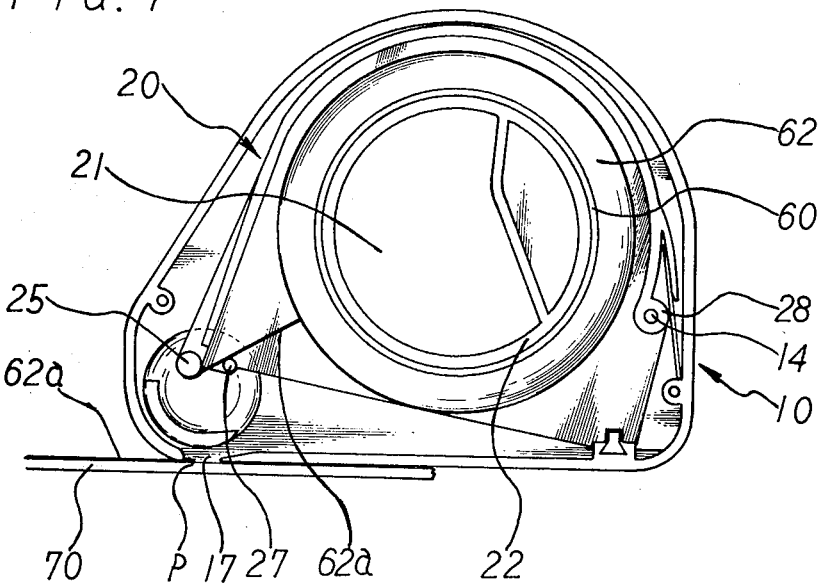
FIG. 7 is a side elevation showing the embodiment of FIG. 1 when a swing member has been released after the adhesive tape has been cut.

With reference to FIG. 5, when the tape 62 is cut by the cutter 45 on the rotatable member 40, the distance $L_1$ (e.g. about 18 mm) between the center $O_1$ of the guide roller 27 and the end point $O_2$ of the adhesion of the tape 62 to the article 70 is larger than the distance $L_3$ (e.g. about 13 mm) between the center $O_1$ and the center $O_2$ of the press roller 25. The cut-off piece of the tape 62 has not been completely adhered to the article 70 upon cutting but is completely adhered when the left-side edge of the bottom wall of the body 10 defining the opening 17 comes to a position P. The distance $L_2$ (e.g. about 13 mm), shown in FIG. 5, between the center $O_1$ of the guide roller 27 and the position $O_4$ where the tape 62 is cut, can be set equal to the distance $L_1$. If $L_1$ is equal to $L_2$, there is the advantage that when the swing member 20 in the state of FIG. 7 is subsequently depressed to the position of FIG. 4, the press roller 25 starts to adhere the leading end 62*a* of the tape 62 at a position which is in agreement with the position P. Additionally the applicator, when used for another article, starts the application of the tape at a position immediately below the center $O_3$ of the press roller 25. This ensures greatly facilitated positioning.

The finger inserting apertures 11 and 21, which are disposed centrally of the tape applicator, are advantageous in that the center opening of large tape rolls can be utilized. Further since the finger inserting apertures and finger engaging piece are provided centrally of the applicator, the applicator, even if large-sized, is usable with a small force with stability.

The spring 64, biasing the swing member 20 clockwise in FIG. 3 when it is in depressed position, permits a quick tape cutting action. Moreover, even if such a quick action produces a shake, the roller belt 60 acts to keep the paid-out tape portion under specified tension, enabling the cutter to cut the tape neatly at all times. Since the tape is cut substantially by the force of the forefinger without resorting solely to the force of the spring 64, the cutter 45 will not be subjected to any objectionable force and is usable for a prolonged period of time.

Because the circular arc peripheral wall 43 of the rotatable member 40 extends from a peripheral portion of the disc 41 in a counterclockwise direction in FIG. 3 and terminates to provide an end which is slanted leftward from the front side toward the rear side and which is provided with a cutter, the cutter 45 is similarly slanted leftward toward the rear side and is accordingly unlikely to injure the finger when it is inserted into the body rearward. The protecting projection 47 provided at the front side of the slanting end serves to preclude contact between the cutter and the finger thus inserted into the body to ensure safety. Also, since the cutter 45 is attached to the rotatable member 40 in this manner, the cutter 45 can cut off the tape readily.

The body 10 and cover 50, when made of transparent material, enable the user to check the tape end for proper positioning during use.

It is to be understood that the invention is not limited in its application to the details of construction and arrangement of parts set forth in the above general description or illustrated in the accompanying drawings, since the invention is capable of other embodiments and of being practiced or carried out in various ways. Also, it is to be understood that the phraseology or terminology employed herein is for the purpose of description and not limitation.

What is claimed is:

1. An adhesive tape applicator comprising:

a main body having a finger inserting aperture formed in its center, a swing member housed in the main body and pivotably supported at one end of the main body, the member including a guide roller and a tape press roller at one end and an annular portion in its center for rotatably mounting a roll of adhesive tape, the member further having substantially the same aperture as the above and a finger engaging portion provided in the aperture, a rotatable member provided in the main body and rotatably supported at the other end of the main body, the member including a disc rotatable by the swing member in a direction opposite to the direction of turn of the swing member when the swing member is turned toward the rotatable member and a peripheral wall projecting from the disc toward the front, a spring mounted on the main body to bias the swing member away from the rotatable member, a revolving split ring in the form of a partially cut ring interposed between the annular portion and the tape roll, a cutter attached to a slanting end of the peripheral wall of the rotatable member slanting toward the other end of the main body from the front toward the rear, and a cover detachably fittable to the main body and having substantially the same aperture as the above, whereby the pressure of fingers inserted in said aperture against said fingers engaging portion is substantially sufficient to cut said adhesive tape.

2. The adhesive tape applicator of claim 1, wherein the rotatable member has a protecting projection at the front side of the slanting end.

3. The adhesive tape applicator of claim 1, wherein a safety stopper is inserted in a stopper guide provided at a bottom portion of the main body and engageable in a stopper hole formed in a bottom portion of the swing member.

4. The adhesive tape applicator of claim 3, wherein when the swing member is turned toward the rotatable member after removing the cover from the main body, the safety stopper is pushable rearward into engagement with the stopper hole to lock the swing member to the main body.

* * * * *